US010973325B1

(12) United States Patent
Morgan

(10) Patent No.: US 10,973,325 B1
(45) Date of Patent: Apr. 13, 2021

(54) DESK TOP SAFETY PARTITION

(71) Applicant: Goff's Enterprises, Inc., Pewaukee, WI (US)

(72) Inventor: Brian Morgan, Oconomowoc, WI (US)

(73) Assignee: GOFF'S ENTERPRISES, INC., Pewaukee, WI (US)

( * ) Notice: Subject to any disclaimer, the term of this patent is extended or adjusted under 35 U.S.C. 154(b) by 0 days.

(21) Appl. No.: 17/005,370

(22) Filed: Aug. 28, 2020

(51) Int. Cl.
*A47B 96/04* (2006.01)
*G09F 15/00* (2006.01)
*A47G 5/00* (2006.01)

(52) U.S. Cl.
CPC ..... *A47B 96/04* (2013.01); *A47G 5/00* (2013.01); *G09F 15/0062* (2013.01); *A47B 2200/12* (2013.01)

(58) Field of Classification Search
CPC ..... A47B 96/04; A47B 2200/12; A47B 2200/0084; A47B 97/00; A47G 5/00; G09F 15/00; G09F 15/0018; G09F 15/0025; G09F 15/0062; G09F 15/0056; G09F 15/0068; G09F 17/00; E04B 2/7433; E04B 2002/7461; E04B 2002/7462
See application file for complete search history.

(56) References Cited

U.S. PATENT DOCUMENTS 2,533,324 A * 12/1950 Mendle ..... A47G 25/0664 211/206
3,326,147 A * 6/1967 Toney ..... A47B 17/00 108/27
3,494,405 A * 2/1970 Bartelmas ..... G03B 21/58 160/24
5,090,587 A * 2/1992 Brown ..... A47F 5/0018 211/81
5,169,258 A * 12/1992 Raynak ..... E04B 1/585 403/170
5,348,368 A * 9/1994 Garcia ..... A47D 1/008 297/148
6,161,320 A * 12/2000 Peterson ..... G09F 15/0025 160/135
6,182,740 B1 * 2/2001 Pfaff ..... A47G 5/00 160/135
6,370,803 B1 * 4/2002 Burquest ..... G09F 15/0025 40/607.04
9,622,570 B1 * 4/2017 Holdredge ..... E04H 1/125
10,159,358 B2 * 12/2018 Wells ..... A47D 1/0083
(Continued)

*Primary Examiner* — Hanh V Tran
(74) *Attorney, Agent, or Firm* — Donald J. Ersler

(57) ABSTRACT

A desk top safety partition preferably includes a sheet frame, a clear flexible sheet and a pair of legs. The sheet frame includes a pair of vertical poles, a pair of horizontal poles and four pole connectors. Each pole connector includes a side hole and a lengthwise bore. The side hole and the lengthwise bore are sized to receive the poles. Two pole connectors are pushed on to each end of a horizontal pole to form a top support and a bottom support. The clear flexible sheet includes pole loops to receive the vertical poles. Each leg preferably includes a leg pole and three pole connectors. A bottom of the vertical poles are inserted into pole connectors of the pair of legs. A C-shaped safety partition includes three sheet frames, three clear flexible sheets, a plurality of pole connectors and a plurality of routing clamps.

19 Claims, 5 Drawing Sheets

(56) References Cited

U.S. PATENT DOCUMENTS

2001/0003878 A1* 6/2001 Dawkins ..... G09F 17/00 40/603
2004/0111943 A1* 6/2004 Pollack ..... G09F 15/0068 40/780
2005/0097798 A1* 5/2005 Evans ..... G09F 15/0087 40/610
2005/0126446 A1* 6/2005 Nobles ..... A47C 7/72 108/27
2006/0137232 A1* 6/2006 Mann ..... G09F 15/0068 40/610
2007/0006498 A1* 1/2007 Collins ..... G09F 15/0025 40/610
2007/0160801 A1* 7/2007 Johnstone ..... G09F 15/0025 428/98
2010/0133395 A1* 6/2010 Durello ..... A47F 5/16 248/158
2010/0282696 A1* 11/2010 Shang ..... A47B 96/04 211/34
2011/0239908 A1* 10/2011 Nakamura ..... A47B 21/00 108/50.11
2012/0279102 A1* 11/2012 Topcuoglu ..... G09F 15/0062 40/606.01
2012/0312948 A1* 12/2012 Maguire ..... G09F 15/0062 248/309.1
2013/0008617 A1* 1/2013 Rivera ..... E04H 15/005 160/127
2013/0239856 A1* 9/2013 Lee ..... G09F 23/08 108/50.17
2014/0109449 A1* 4/2014 Cavalieri ..... G09F 7/10 40/606.18
2014/0202897 A1* 7/2014 Collins ..... A45C 3/001 206/315.1
2014/0311036 A1* 10/2014 Alexander ..... E04B 2/7425 49/463
2016/0249750 A1* 9/2016 Taylor ..... A47F 5/105 211/186
2017/0178550 A1* 6/2017 Miller ..... G09F 15/0062
2018/0319476 A1* 11/2018 Araujo ..... B64B 1/34
2019/0059602 A1* 2/2019 Gobron ..... A47G 9/02
2019/0279542 A1* 9/2019 Wicken ..... G09F 15/0037
2020/0232211 A1* 7/2020 Pan ..... E04B 2/7422
2020/0288867 A1* 9/2020 Knapp ..... E06B 9/42

* cited by examiner

DESK TOP SAFETY PARTITION

BACKGROUND OF THE INVENTION

1. Field of the Invention

The present invention relates generally to the prevention of infection and more specifically to a desk top safety partition, which allows a clear flexible sheet to be used for protection, instead of an expensive rigid plexiglass material.

2. Discussion of the Prior Art

Presently, plexiglass is used to protect individuals from exposure to infection from viruses, such as COVID-19. However, plexiglass is very expensive and the supply of the plexiglass is presently in limited supply, because of the extraordinary demand. Further, plexiglass is very brittle and can be easily damaged.

Accordingly, there is a clearly felt need in the art for a desk top safety partition, which allows a clear flexible sheet to be used for protection, instead of an expensive rigid plexiglass material.

SUMMARY OF THE INVENTION

The present invention provides a desk top safety partition, which allows a clear flexible sheet to be used for protection, instead of plexiglass. The desk top safety partition (safety partition) preferably includes a sheet frame, a clear flexible sheet and a pair of legs. The sheet frame includes a pair of vertical poles, a pair of horizontal poles and four pole connectors. Each pole connector includes a side hole and a lengthwise bore. The side hole goes through a thickness of the pole connector. The lengthwise bore goes through substantially all of a length of the connector, but does not intersect the side hole. The side hole and the lengthwise bore are sized to firmly receive the pair of vertical poles and the pair of horizontal poles. The side hole is perpendicular to the lengthwise bore. The clear flexible sheet includes pole loops formed on opposing sides to receive the pair of vertical poles. The pole loops are formed by folding over opposing edges of the clear flexible sheet. The opposing edges are attached to itself with heat welding, a bonding substance or any other suitable process. Each leg preferably includes a leg pole and three pole connectors. The vertical poles, the horizontal poles and the leg poles are preferably fabricated from a fiberglass pultrusions, but other materials may also be used. The pole connectors are preferably fabricated from ABS plastic, but other materials may also be used.

The safety partition is preferably assembled in the following manner. Two pole connectors are pushed on to opposing ends of one of the two horizontal poles to form a top support. Two pole connectors are pushed on to opposing ends of the other one of the two horizontal poles to form a bottom support. The pair of vertical poles are pushed through the opposing loops in the clear flexible sheet. Each leg is assembled by inserting the leg pole through the side hole in one of the pole connectors, such that the pole connector is located in a middle of the leg pole. Each end of the leg pole is inserted into the lengthwise bore of one of the pole connectors. A top of each vertical pole is inserted through side holes in the pole connectors on opposing ends of the top support. A bottom of each vertical pole is inserted through side holes in the pole connectors on opposing ends of the bottom support and into the lengthwise holes in the pole connectors on the pair of legs.

A C-shaped safety partition includes three sheet frames, three clear flexible sheets, a plurality of pole connectors and a plurality of routing clamps. Each routing clamp includes two parallel snap cavities, which are sized to receive two parallel vertical poles. The routing clamps may be purchased from McMaster-Carr. However, other devices for retaining two parallel vertical poles may also be used. Three sheet frames with the clear flexible sheet are assembled. A bottom of each vertical pole is inserted into the lengthwise bore of the pole connector. Two adjacent frames are connected to each other with two routing clamps, such that a C-shaped safety partition is formed.

Accordingly, it is an object of the present invention to provide a safety partition, which allows a clear flexible sheet to be used for protection, instead of an expensive rigid plexiglass material.

These and additional objects, advantages, features and benefits of the present invention will become apparent from the following specification.

DETAILED DESCRIPTION OF THE PREFERRED EMBODIMENTS

Figure 1:
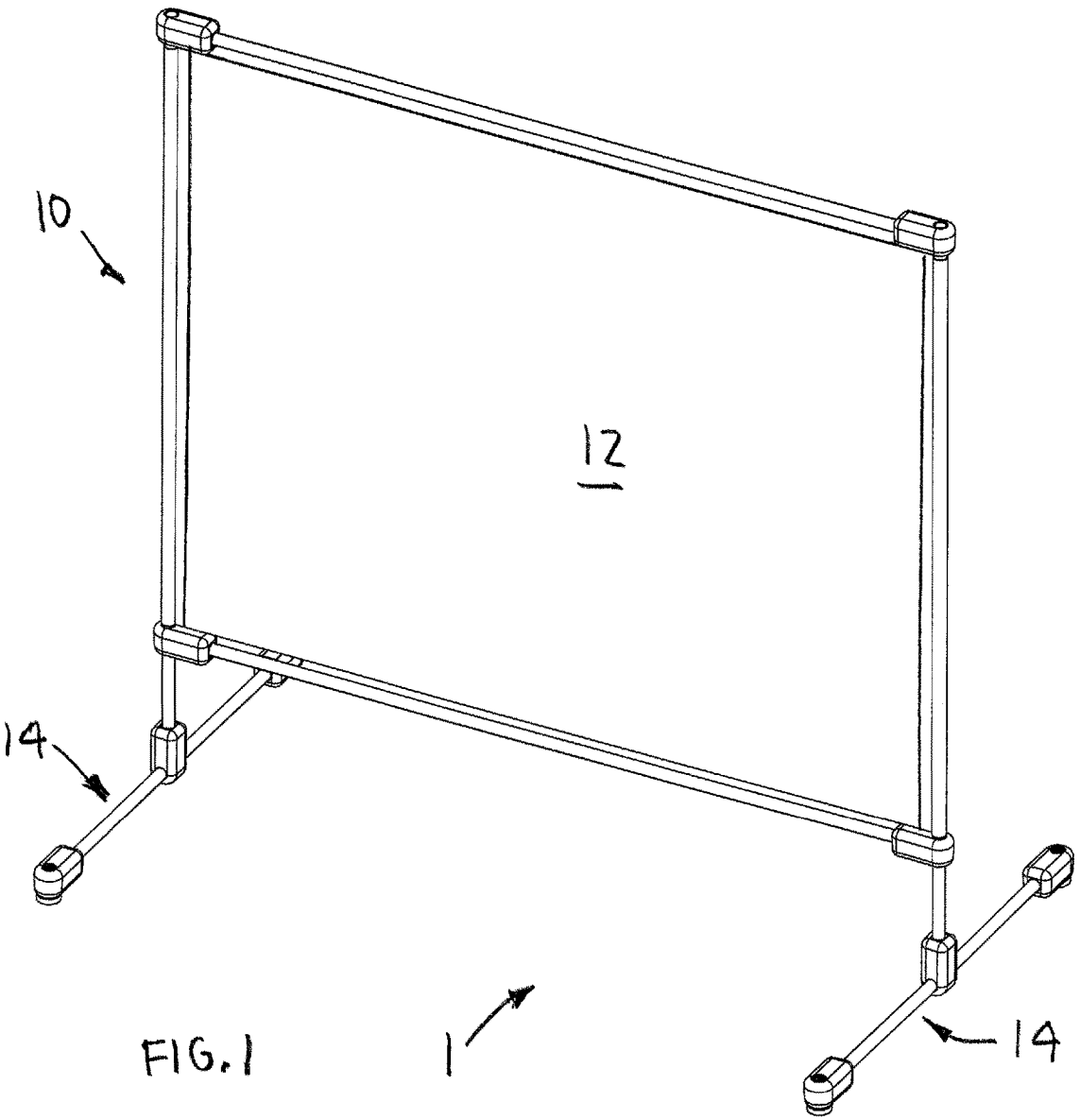
FIG. 1 is a perspective view of a safety partition in accordance with the present invention.
Figure 2:
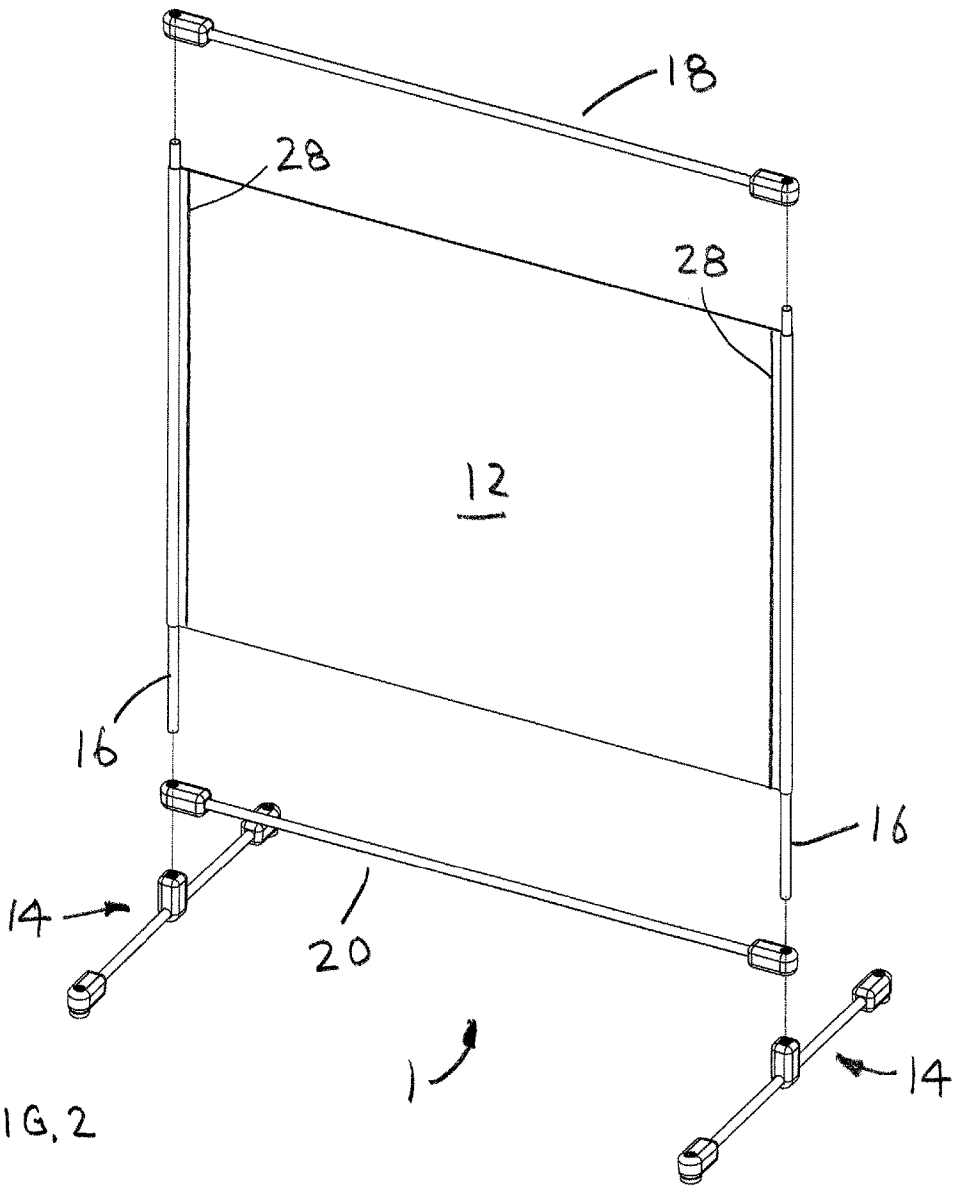
FIG. 2 is a partially exploded perspective view of a safety partition in accordance with the present invention.
Figure 6:
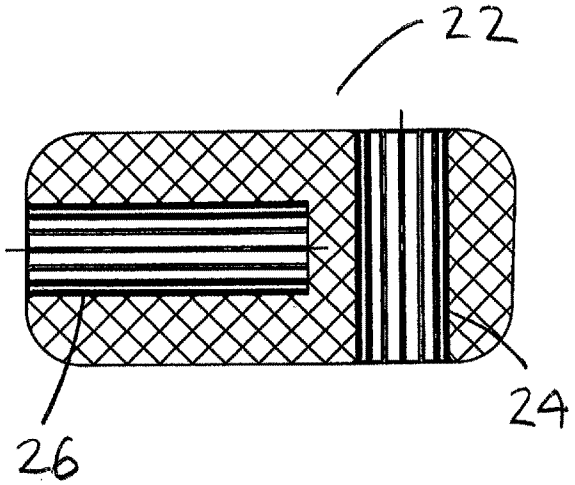
FIG. 6 is a cross sectional view of a pole connector in FIG. 5 of a safety partition in accordance with the present invention.
Figure 5:
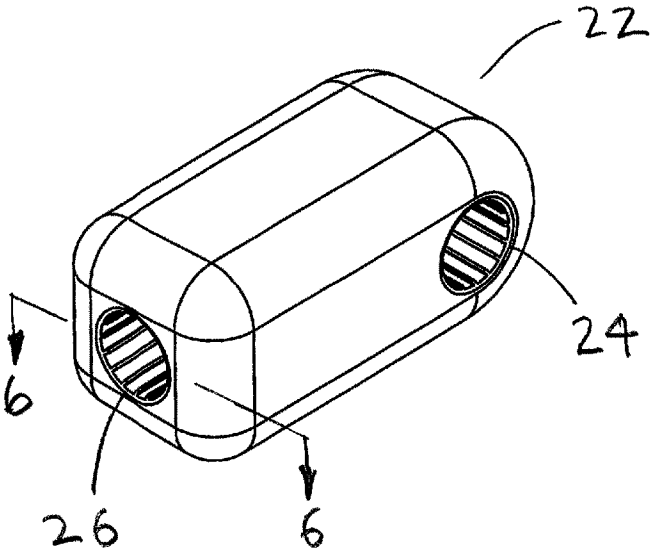
FIG. 5 is a perspective view of an pole connector of a safety partition in accordance with the present invention.

With reference now to the drawings, and particularly to FIG. 1, there is shown a perspective view of a safety partition 1. With reference to FIG. 2, the safety partition 1 preferably includes a sheet frame 10, a clear flexible sheet 12 and a pair of legs 14. The sheet frame 10 preferably includes a pair of vertical poles 16, a pair of horizontal poles 30 and four pole connectors 22. With reference to FIGS. 5-6, each pole connector 22 includes a side hole 24 and a lengthwise bore 26. The side hole 24 goes through a thickness of the pole connector 22. The lengthwise bore 26 goes through substantially all of a length of the pole connector 22, but does not intersect the side hole 24. The side hole 24 and the lengthwise bore 26 are sized to firmly receive the pair of vertical poles 16 and the pair of horizontal poles 30. The side hole 24 is perpendicular to the lengthwise bore 26. The clear flexible sheet 12 includes pole loops 28 formed on opposing sides to receive the pair of vertical poles. The pole loops 28 are formed by folding over opposing edges of the clear flexible sheet 12. The opposing edges 28 are attached to itself with heat welding, a bonding substance or any other suitable process.

Figures 3, 4:
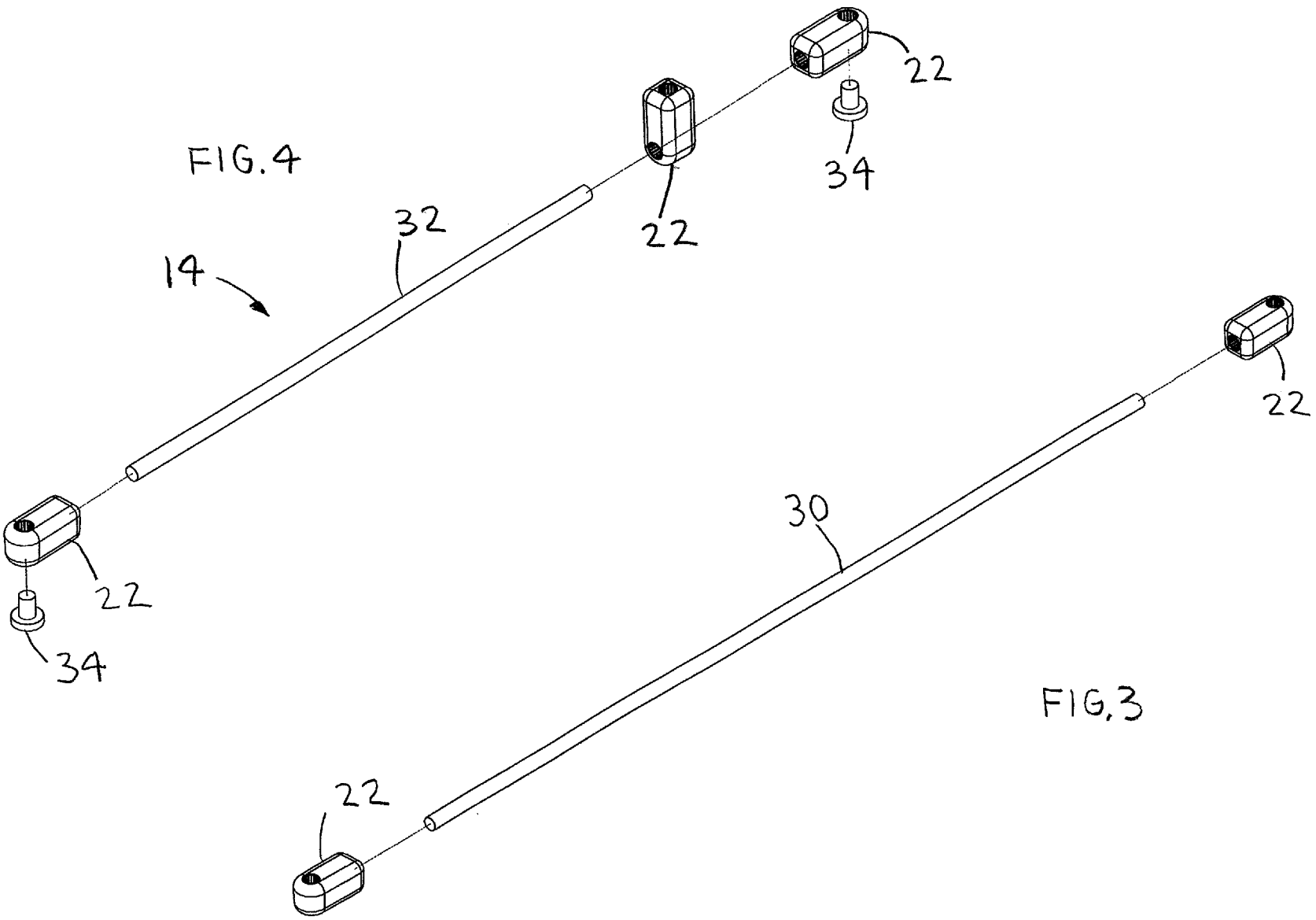
FIG. 3 is an exploded perspective view of a top support or a bottom support of a safety partition in accordance with the present invention.
FIG. 4 is an exploded perspective view of a leg of a safety partition in accordance with the present invention.

With reference to FIG. 3, a top support 18 and a bottom support 20 each include a horizontal pole 30 and two pole connectors 22. Each end of the horizontal pole 30 is inserted into the lengthwise bore 26 of the pole connector 22. With reference to FIG. 4, each leg 14 preferably includes a leg pole 32, three pole connectors 22 and two feet 34. The leg pole is inserted through the side hole 24 of one of the three pole connectors 22. Each end of the leg pole 32 is inserted into lengthwise holes 26 of the two remaining pole connectors 22. The feet 34 are inserted into the side holes 24 of the two remaining pole connectors 22. However, other types of legs may also be used.

The vertical poles 16, the horizontal pole 30 and the leg poles 32 are preferably fabricated from a fiberglass pultrusions, but other materials may also be used. The pole connectors 22 are preferably fabricated from ABS plastic, but other materials may also be used. The feet 34 are purchased from any number of vendors.

The safety partition 1 is preferably assembled in the following manner. Opposing ends of the horizontal pole 30 are pushed into the lengthwise holes 26 of two pole connectors 22 for the top support 18 and the bottom support 20. The pair of vertical poles 16 are pushed through the opposing loops 28 in the clear flexible sheet 12. Each leg 14 is assembled by inserting the leg pole 32 through the side hole 24 in one of the pole connectors 22, such that the pole connector is located in a middle of the leg pole 32. Each end of the leg pole 32 is inserted into the lengthwise bore 26 of one of the two other pole connectors 22. A top of each vertical pole 16 is inserted through the side holes 24 in the pole connectors 22 of the top support 18. A bottom of each vertical pole 16 is inserted through the side holes 24 in the pole connectors 22 on opposing ends of the bottom support 20 and into the lengthwise holes 26 in the pole connectors 22 on the pair of legs 14.

Figure 7:
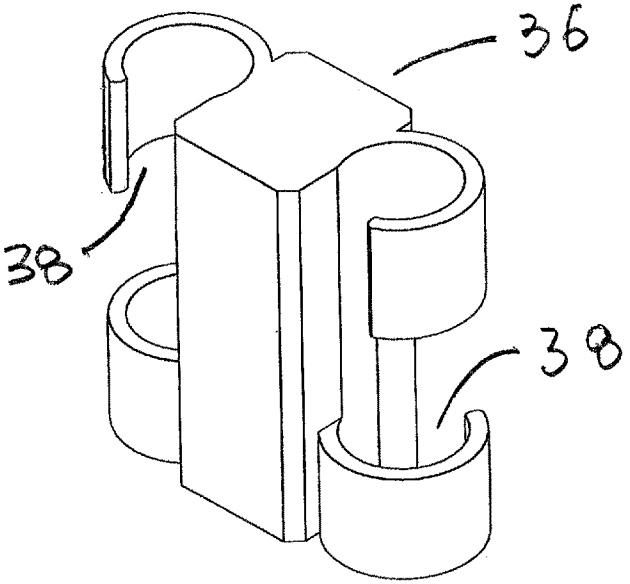
FIG. 7 is a perspective view of a routing clamp of a safety partition in accordance with the present invention.
Figure 8:
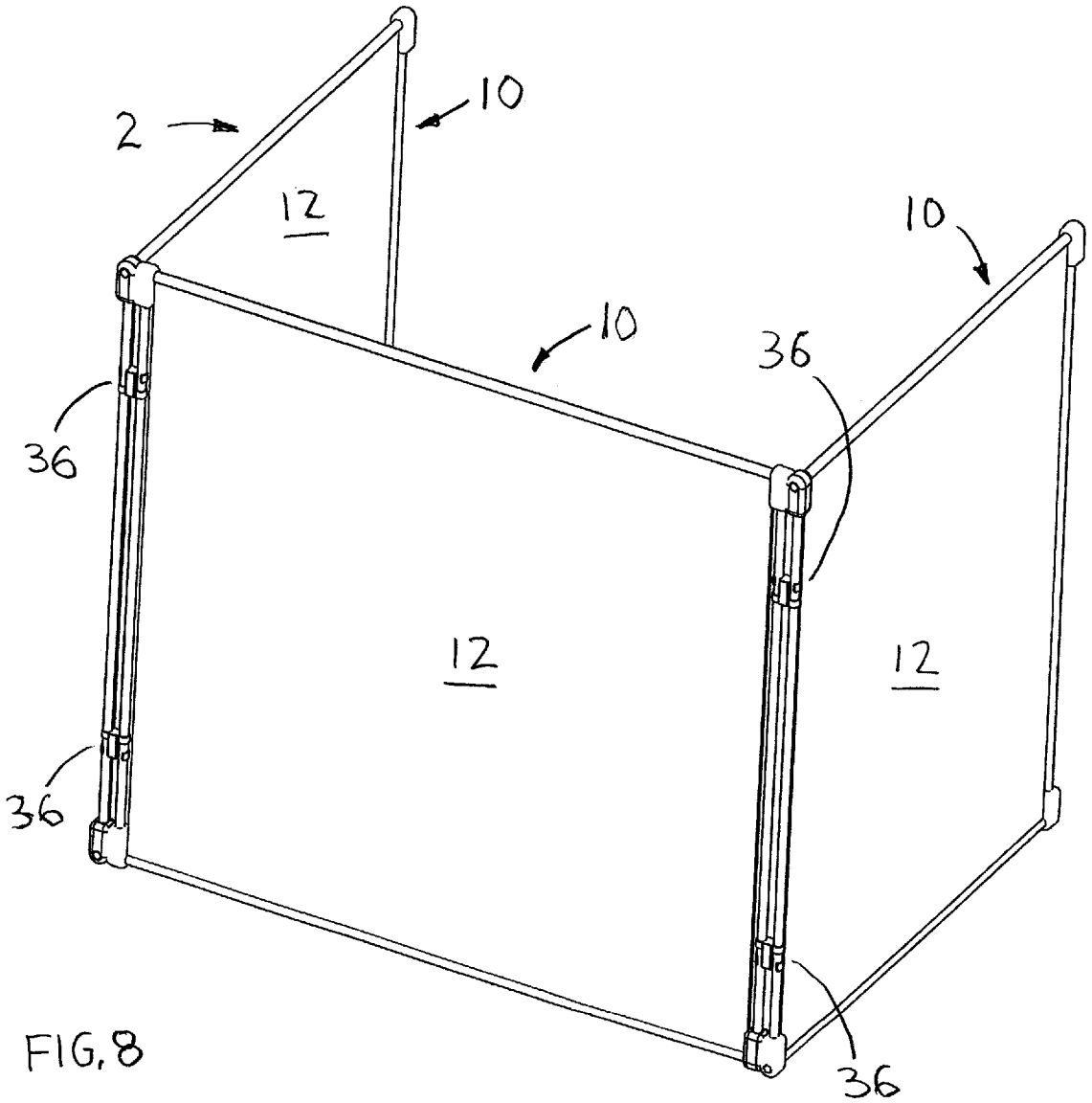
FIG. 8 is a perspective view of a C-shaped safety partition in accordance with the present invention.

With reference to FIGS. 7-8, a C-shaped safety partition 2 includes three sheet frames 10, three clear flexible sheets 12, a plurality of pole connectors 22 and a plurality of routing clamps 36. Each routing clamp 36 includes two parallel snap cavities 38, which are sized to receive two parallel vertical poles 16. The routing clamps 36 may be purchased from McMaster-Carr. However, other devices for clamping two parallel vertical poles 16 may also be used. Three sheet frames 10 with the clear flexible sheet 12 are assembled. A bottom of each vertical pole 16 is inserted into the lengthwise bore 26 of the pole connector 22. Two adjacent frames 10 are connected to each other with two routing clamps 36, such that a C-shaped safety partition is formed.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A desk top safety partition comprising:

a sheet frame includes a pair of vertical poles, a pair of horizontal poles and four pole connectors;

two legs each include a leg pole and a leg pole connector; and a clear flexible sheet includes a pair of loops formed on opposing edges thereof to receive said pair of vertical poles, wherein each end of one of said pair of horizontal poles are inserted into two of said four pole connectors to form a top support, each end of a second one of said pair of horizontal poles is inserted into another two of said four pole connectors to form a bottom support, a top of said pair of vertical poles are inserted through said two pole connectors of said top support, a bottom of said pair of vertical poles are inserted through said two pole connectors of said bottom support and into said two leg pole connectors.

2. The desk top safety partition of claim 1 wherein:

each of said four pole connectors includes a lengthwise hole and a side hole, said side hole goes through a thickness of said pole connector, said lengthwise hole goes through a portion of a length of said pole connector.

3. The desk top safety partition of claim 2 wherein:

said side hole is perpendicular to said lengthwise hole.

4. The desk top safety partition of claim 1 wherein:

said pair of horizontal poles and said pair of vertical poles are fabricated from fiberglass pultrusions.

5. The desk top safety partition of claim 1 wherein:

said four pole connectors are fabricated from ABS plastic.

6. A desk top safety partition comprising:

a sheet frame includes a pair of vertical poles, a pair of horizontal poles and four pole connectors;

a pair of legs;

a clear flexible sheet includes a pair of loops formed on opposing edges thereof to receive said pair of vertical poles, wherein each end of one of said pair of horizontal poles is inserted into two of said four pole connectors to form a top support, each end of a second one of said pair of horizontal poles is inserted into two of said four pole connectors to form a bottom support, a top of said pair of vertical poles are inserted through said two pole connectors of said top support, a bottom of said pair of vertical poles are inserted through said two pole connectors of said bottom supports and into said pair of legs.

7. The desk top safety partition of claim 6 wherein:

each of said four pole connectors includes a lengthwise hole and a side hole, said side hole goes through a thickness of said pole connector, said lengthwise hole goes through a length of said pole connector, but does not intersect said side hole.

8. The desk top safety partition of claim 7 wherein:

said side hole is perpendicular to said lengthwise hole.

9. The desk top safety partition of claim 7 wherein:

each one of said pair of legs includes a leg pole and three leg pole connectors.

10. The desk top safety partition of claim 6 wherein:

said pair of horizontal poles and said pair of vertical poles are fabricated from fiberglass pultrusions.

11. The desk top safety partition of claim 9, further comprising:

feet are retained in said two of said three pole connectors.

12. The desk top safety partition of claim 6 wherein:

said four pole connectors are fabricated from ABS plastic.

13. A desk top safety partition comprising:

at least two sheet frames each include a pair of vertical poles, a pair of horizontal poles and four pole connectors;

at least one routing clamp;

at least one pair of legs; and at least two clear flexible sheets each include a pair of loops formed on opposing edges thereof to receive said pair of vertical poles, wherein each end of one of said pair of horizontal poles is inserted into two of said four pole connectors to form a top support, each end of a second one of said pair of horizontal poles is inserted into two of said four pole connectors to form a bottom support, a top of said pair of vertical poles are inserted through said two pole connectors of said top support, a bottom of said pair of vertical poles are inserted through said two pole connectors of said bottom supports at least two of said four vertical poles are inserted and into said at least one pair of legs, said at least two frames are secured to each other with said at least one routing clamp.

14. The desk top safety partition of claim 13 wherein: each of said four pole connectors includes a lengthwise hole and a side hole, said side hole goes through a thickness of said pole connector, said lengthwise hole goes through a length of said pole connector, but does not intersect said side hole.

15. The desk top safety partition of claim 14 wherein: said side hole is perpendicular to said lengthwise hole.

16. The desk top safety partition of claim 13 wherein: said pair of horizontal poles and said pair of vertical poles are fabricated from fiberglass pultrusions.

17. The desk top safety partition of claim 13 wherein: said four pole connectors are fabricated from ABS plastic.

18. The desk top safety partition of claim 13 wherein: said at least one routing clamp includes a first snap cavity and a second snap cavity.

19. The desk top safety partition of claim 18 wherein: said first and second snap cavities are parallel to each other.

* * * * *